US006314685B1

(12) United States Patent
Sullivan

(10) Patent No.: US 6,314,685 B1
(45) Date of Patent: Nov. 13, 2001

(54) GUTTER ENHANCING DEVICE AND METHOD

(76) Inventor: Brian Sullivan, 48 N. Chapel St., Torrington, CT (US) 06790

( * ) Notice: Subject to any disclaimer, the term of this patent is extended or adjusted under 35 U.S.C. 154(b) by 0 days.

(21) Appl. No.: 09/368,625

(22) Filed: Aug. 5, 1999

(51) Int. Cl.[7] ..... E04D 13/00
(52) U.S. Cl. ..... 52/12; 52/11
(58) Field of Search ..... 52/11, 12, 15, 52/94, 95, 97, 105; 210/455, 474, 477, 163; 248/48.1, 48.2; D25/164

(56) References Cited

U.S. PATENT DOCUMENTS

| | | | | |
|---|---|---|---|---|
| D. 328,500 | | 8/1992 | Hardy . | |
| 3,507,078 | | 4/1970 | Sayers, Sr. | 52/15 |
| 3,592,721 | * | 7/1971 | Formanek et al. | 52/11 X |
| 3,826,048 | | 7/1974 | Merkin et al. | 52/11 |
| 3,977,135 | | 8/1976 | Hunley, Jr. | 52/12 |
| 4,186,531 | | 2/1980 | Okolischan | 52/11 |
| 4,226,056 | | 10/1980 | Hallam | 52/11 |
| 4,769,526 | * | 9/1988 | Taouil | 52/12 X |
| 4,769,957 | * | 9/1988 | Knowles | 52/12 |
| 5,271,192 | | 12/1993 | Nothum, Sr. et al. | 52/12 |
| 5,438,803 | * | 8/1995 | Blizard, Jr. | 52/12 |
| 5,537,785 | | 7/1996 | Zaccagni | 52/11 |
| 5,555,680 | | 9/1996 | Sweers | 52/12 |
| 5,640,810 | | 6/1997 | Pietersen | 52/12 |
| 5,724,776 | | 3/1998 | Meadows, Jr. | 52/94 |
| 5,727,350 | | 3/1998 | Marcella | 52/12 |
| 5,842,311 | | 12/1998 | Morin | 52/12 |
| 5,862,631 | * | 1/1999 | Attaway et al. | 52/11 |

OTHER PUBLICATIONS

Brochure entitled "Beware of proven failures"—'Aussie Gutter', 2 pages, Jan. 1985.*

* cited by examiner

*Primary Examiner*—Peter M. Cuomo
*Assistant Examiner*—James O. Hansen
(74) *Attorney, Agent, or Firm*—Handal & Morofsky

(57) ABSTRACT

A gutter enhancing device having a flexible member for being applied to and covering the exterior configuration of an existing gutter trough. The device also has a flexible screen portion for covering the top portion or opening of the gutter trough.

13 Claims, 16 Drawing Sheets

GUTTER ENHANCING DEVICE AND METHOD

BACKGROUND OF THE INVENTION

The present invention relates to a gutter cover and/or shield which is applied to an existing gutter system. The present invention improves the performance and aesthetic quality of the existing gutter. In addition, the present invention also provides a debris accumulation prevention system which allows water to run through the gutter while preventing materials such as leaves, dirt, branches and other matter from becoming lodged in the gutter.

Typically, a gutter system comprises a gutter trough constructed out of a single or multiple sections and appropriately placed down spouts.

Gutters are generally secured to the fascia board of a building. The materials which comprise the roof of the building are positioned to overhang the fascia board, whereby rain and/or melting snow runs off of the roof and into the gutter.

The gutter trough generally comprises an elongated channel section which is positioned just below the overhang of the first course of roofing material. The gutter is positioned to receive the water runoff and channel it away from the building.

As can be expected, a gutter can become easily clogged through the accumulation of materials such as, leaves, debris, insect nests, bird nests, and the like.

Accordingly, numerous screening devices for an existing gutter are available. These devices are generally limited to an insert which is placed over the trough opening of an existing gutter. However and despite the placement of a screening device, periodic cleaning of a gutter is still necessary.

Other screening devices which are available incorporate a screening device that is secured to the gutter through the use of a hinge which is secured to either the gutter itself or the roofing materials.

The majority of gutter systems currently in use are modular systems constructed out of a lightweight aluminum, copper, steel and in some cases plastic. As these systems begin to age through exposure to various environmental conditions such as, excessive heat, excessive cold, and various precipitations they become unsightly, inefficient and ultimately inoperative. In addition, and as the system ages, it becomes susceptible to molds and other intrusions which adhere themselves to the gutter system.

Also, older aluminum gutter systems become pitted and rusted from exposure to the elements. The pitting and rusting of an existing gutter system, especially at the seam or joint between two gutter troughs, may cause leaks and seriously affect the efficiency of the system.

Moreover, such pitting and rusting makes it practically impossible to paint the gutter in order to improve its appearance.

Accordingly, and as a gutter system ages the performance and overall appearance of the system is adversely affected. Moreover, most gutter systems are painted white which further enhances the problem of unsightly blemishes on the gutter facade.

SUMMARY OF THE INVENTION

An object of present invention is to provide a unitary gutter enhancement device which improves the appearance and performance of an existing gutter.

Another object of the present invention is to provide an improved debris screen for an existing gutter system.

Another object of the present invention is to improve the water flow of a gutter system through the use of an improved debris screen.

Another object of the present invention is to provide an economical means for repairing an existing gutter system.

Another object of present invention is to provide an economical means for changing the overall appearance of an existing gutter system.

Another object of the present invention is to provide a nodular system for use with an existing gutter which improves the efficiency and appearance of the same.

BRIEF DESCRIPTION OF THE DRAWINGS

One way of carrying out the invention is described in detail below with reference to drawings which illustrate only to specific embodiments of the invention.

DETAILED DESCRIPTION OF THE PREFERRED EMBODIMENTS

Figure 1:
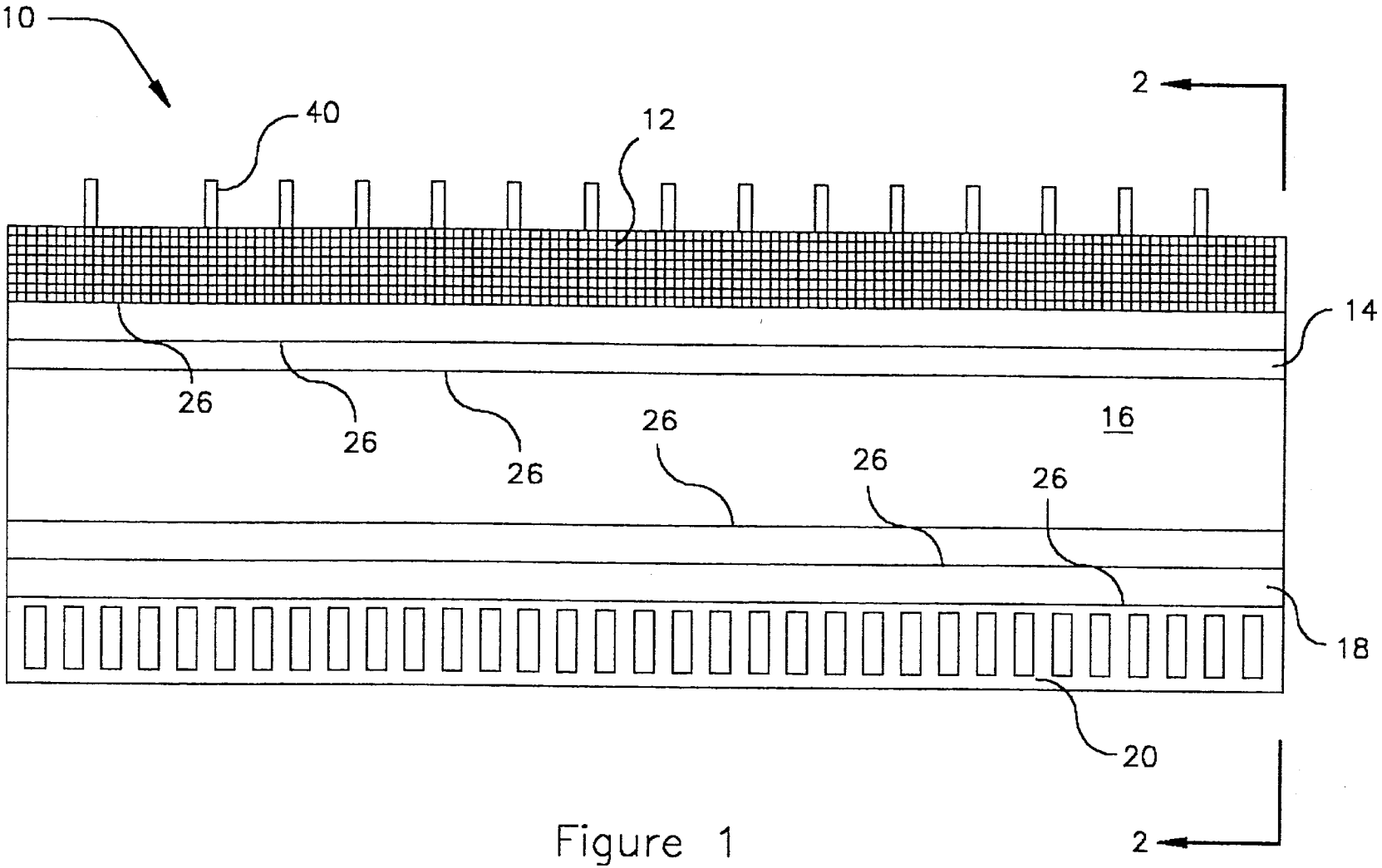
FIG. 1 is a top plane view of the present invention in its unfurled state.

Turning now to FIG. 1, gutter enhancer 10 is illustrated. Gutter enhancer 10 is constructed out of vinyl, plastic and/or aluminum which allows gutter enhancer 10 to be molded, stamped and/or pressed during manufacture. In addition, the flexible nature of gutter enhancer 10 allows the same to be mass produced and shipped in convenient packages. Moreover, and as will be discussed below, the pliable nature of gutter enhancer 10 allows for mass production, convenient shipping, multiple configurations and ease of installation.

Gutter enhancer 10 has a screen portion 12, a top molding 14, a decorative fascia surface 16, a bottom molding 18 and a lower trough covering 20. As an alternative, gutter enhancer 10 is constructed without screen portion 12.

In the preferred embodiment gutter enhancer 10 will be constructed out of a soft, rollable, and pliable vinyl, such as poly vinyl chloride. This material can be easily molded or stamped during its curing process which provides multiple configurations of gutter enhancer 10. This material is more resistant to varying weather conditions and exposure to other corrosive conditions such as acid rain.

Whereas, a gutter system constructed out of Aluminum, Steel or Copper will be less resistant to such conditions.

In addition, and as the climate of the geographical location requires, gutter enhancer 10 will have additives that will provide ultraviolet protection to retain color and prevent fading of gutter enhancer 10. One such contemplated additive is titanium dioxide $TiO_2$.

As an alternative, and as climate conditions may require, gutter enhancer 10 will be constructed to have an acrylic coating which will reflect solar energy and reduce the heat buildup to gutter enhancer 10.

Gutter enhancer 10 will be available in a variety of colors which will provide a match to the color of any existing gutter system or complement the trim of a home.

Figure 2:
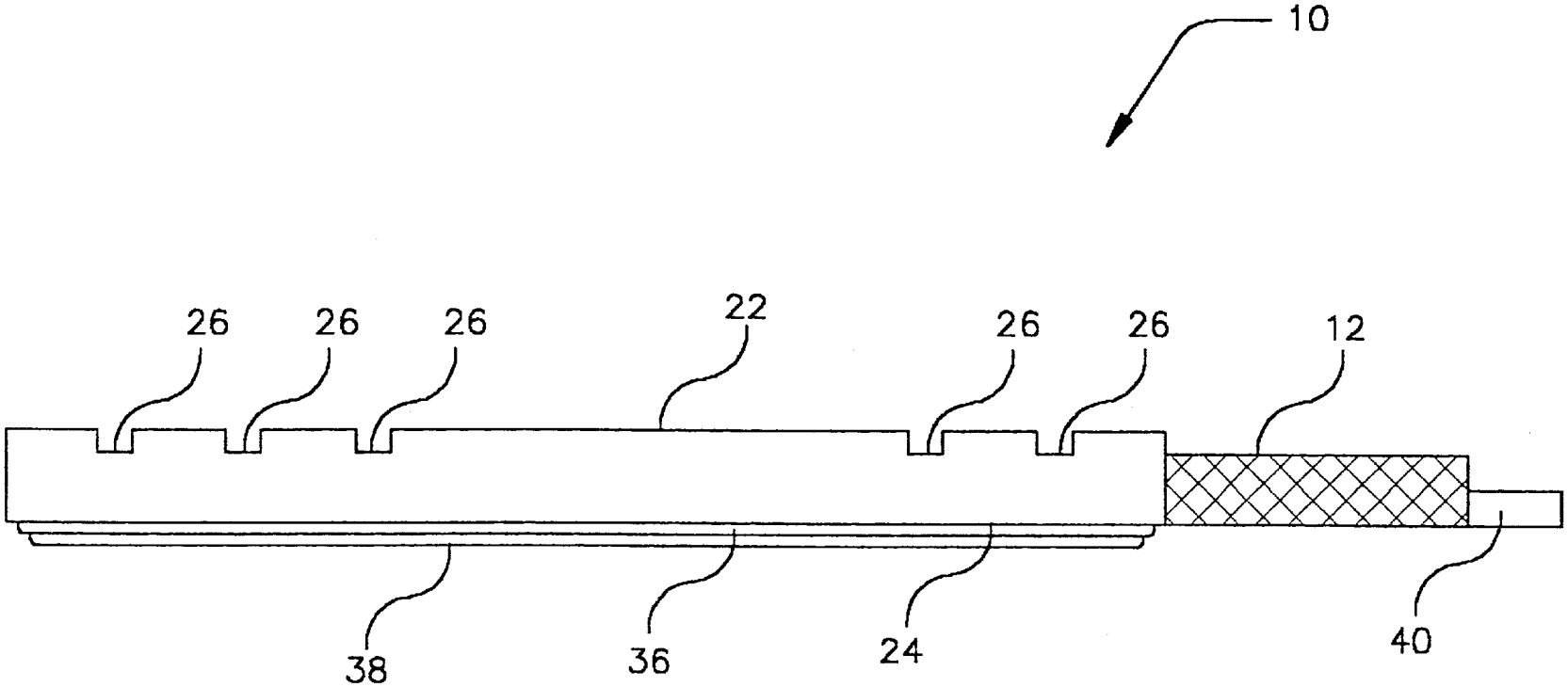
FIG. 2 is a view along lines 2—2 of the FIG. 1 embodiment.

Turning now to FIGS. 1 and 2, gutter enhancer 10 has an outer surface 22 and a backing surface 24. A plurality of creases 26 are positioned along outer surface 22. Plurality of creases 26 do not pass through gutter enhancer 10 and allow gutter enhancer 10 to be manipulated along a line substantially parallel to creases 26.

Figure 3:
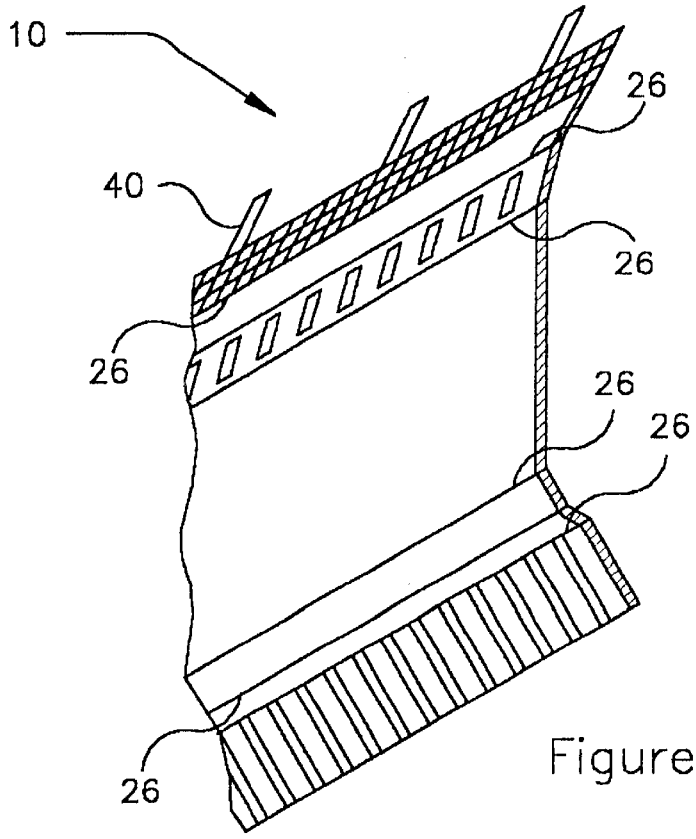
FIG. 3 is a perspective view of the present invention.
Figure 4:
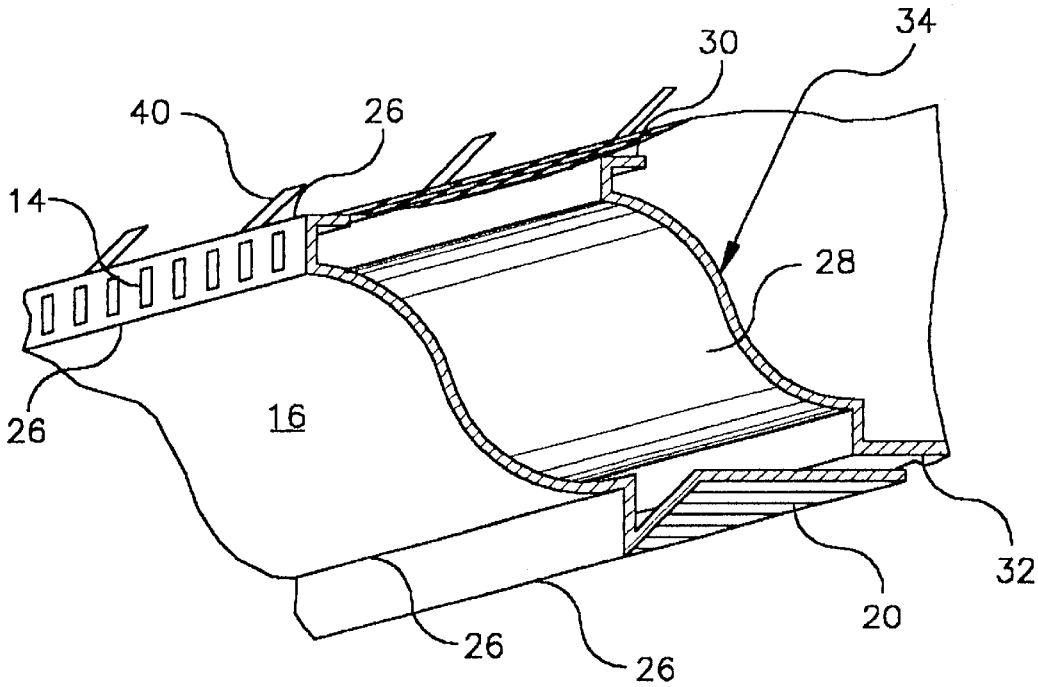
FIG. 4 is a perspective view illustrating operational features of the present invention.

As illustrated in FIGS. 3–4, creases 26 allow gutter enhancer 10 to be folded and manipulated to match, a facade 28, a top 30 and a bottom 32 of an existing gutter 34. In addition, creases 26 are positioned in outer surface 22 of gutter enhancer 10. The positioning and creation of creases 26 is easily accomplished during the manufacture of gutter enhancer 10.

Figure 8:
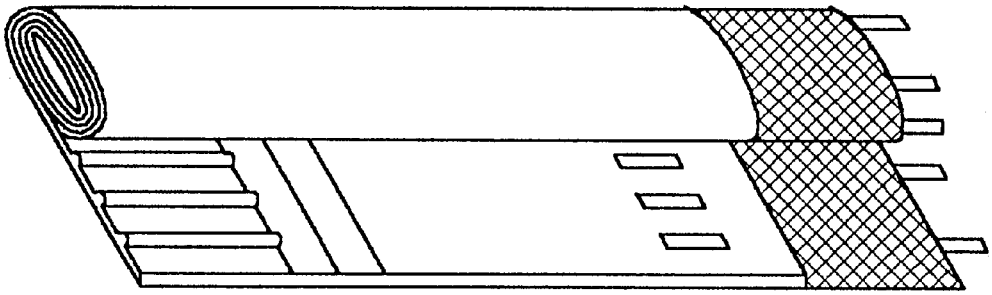
FIG. 8 is a view illustrating a possible shipping configuration of the present invention.

Referring back now to FIG. 2, an adhesive material 36 is applied to backing surface 24 of gutter enhancer 10. A removable protective member 38 is applied to adhesive material 36. Protective member 38 is a wax coated material which prevents protective member 38 from becoming permanently secured to adhesive material 36. Protective member 38 also allows gutter enhancer 10 to be rolled up into a convenient package as illustrated in FIG. 8.

Protective member 38 is removed from adhesive material 36 prior to application of gutter enhancer 10 to an existing gutter 34. However, and in order to facilitate the proper fit of gutter enhancement 10 over an existing gutter system and prior to the removal of protective member 38, an individual may place gutter enhancer 10 over the existing gutter system to take proper measurements. After the measurements are taken, gutter enhancer 10 is easily trimmed with a utility knife or tin snips. Once gutter enhancer 10 is trimmed the installer can place gutter enhancer 10 over the existing gutter to check the fit prior to the removal of protective member 38.

Alternatively, and due to the pliable nature of the present invention, gutter enhancer 10 can be bent upwardly behind an existing gutter. Such an installation does not require cutting of gutter enhancer 10.

Thus, gutter enhancer 10 is easily applied to existing gutter of varying configurations.

Additionally, gutter enhancer 10 may only be secured to the top and bottom of an existing gutter, thereby, changing the physical configuration of the gutter trough. One such an application is illustrated by the dashed lines in FIG. 5. For example, the existing gutter appearance may be changed from one of the configurations illustrated in FIG. 17 to another such configuration. In addition, other such design changes are feasible in accordance with the present invention. In addition, and as an alternative, a insulating material 58 is applied to backing surface 24 of decorative fascia surface 16. Insulating material 58 will minimize noises generated by water running through the gutter, as well as, wind related noises, such the possible tapping of gutter enhancer 10 to the existing gutter.

As yet another alternative, adhesive material 36 is of a sufficient size to provide such insulating characteristics.

Accordingly, and after all the required adjustments are made, the installer simply removes protective member 38 from gutter enhancer 10 and installs the altered gutter enhancer 10 over the existing gutter.

Referring now to FIGS. 1–5 the application of gutter enhancer 10 is illustrated. Here creases 26 are positioned to allow gutter enhancer 10 to be manipulated in order to conform to the configuration of an existing gutter structure 34.

As illustrated, top molding 14, decorative fascia surface 16 and lower trough covering 20 cover the exterior surfaces of existing gutter 34. Top molding 14, decorative fascia surface 16 and lower trough covering 20 provide a completely new appearance to an existing gutter 34. Adhesive material 36 assists in the securement of gutter enhancer 10.

Turning now to FIGS. 13A–16B, numerous designs of decorative fascia surface 16, lower trough covering 20 and top molding 14 can be incorporated into gutter enhancer 10.

In the past, and in order to obtain such a drastic change to the overall appearance of an existing gutter system, the complete removal and replacement of the entire gutter system was necessary.

Figure 5:
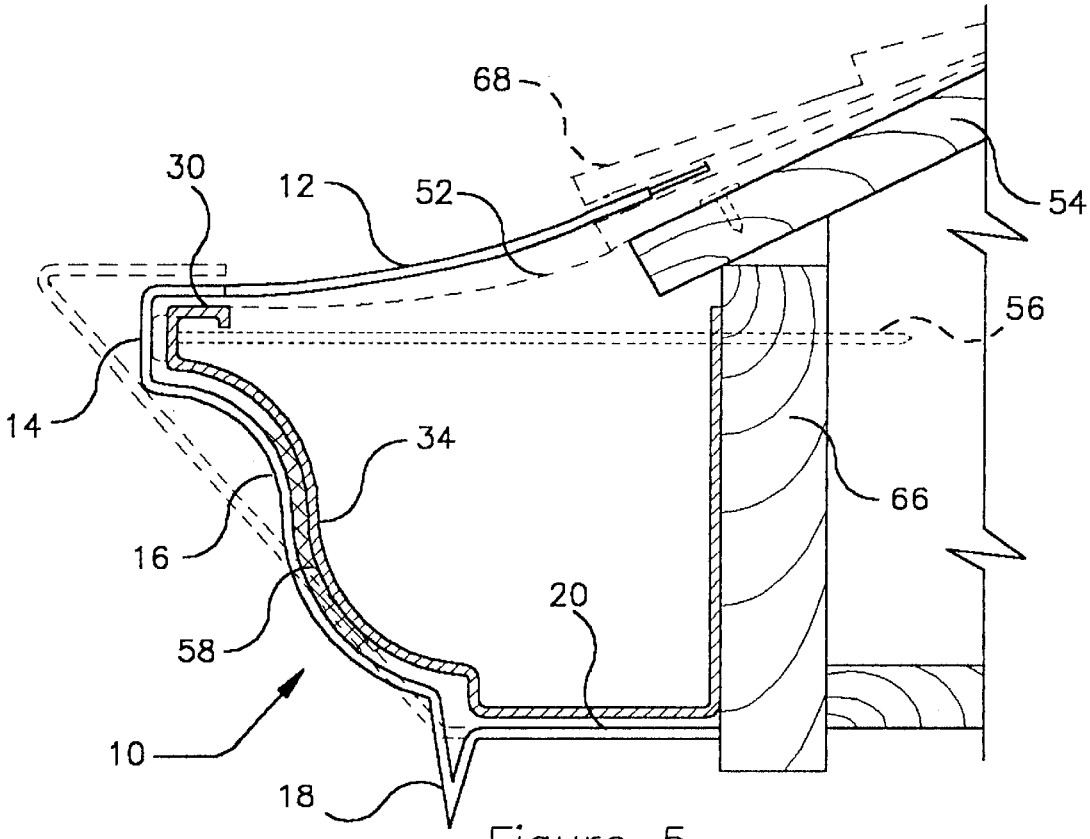
FIG. 5 is a side view of the FIG. 4 embodiment.

Moreover, and as illustrated by the dashed lines in FIG. 5, a support member 52, typical of some gutter installation, secures top 30 of existing gutter 34 to a layer of sheathing 54. Support member 52 is then covered by the shingles and/or the which comprise the roof of the building. Such securement is generally provided by a nail. Therefore, and in order to remove an existing gutter system, some of the roofing materials must be removed and the integrity of the roof may be compromised.

Other installation techniques of existing gutters systems utilize a plurality of elongated nails 56, as illustrated by the dashed lines in FIG. 5, which will also cause damage to an existing fascia board 58 when removed.

Accordingly, the present invention provides a unique and novel way of improving the aesthetic and overall performance of an existing gutter system without having to remove the same. Not only does the present invention provide and economical means for improving and existing gutter system, it also accomplishes the same without causing damage to the existing structure, namely, the roofing materials and trim.

Moreover, such applications of the present invention with cover unsightly dents, seam joints and general wear and tear of the existing gutter system.

Creases 26 and the pliable nature of gutter enhancer 10 allows gutter enhancer 10 to be manipulated to match the exterior configuration of existing gutter 34.

Figure 17:
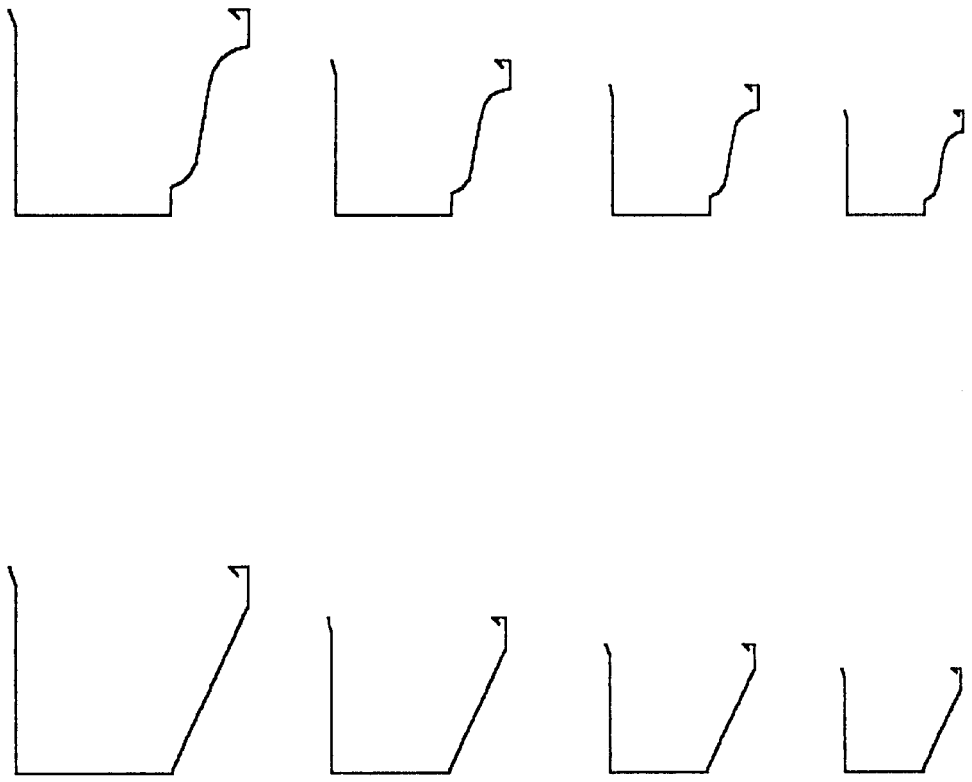
FIG. 17 is view illustrating possible configurations and/or applications of the present invention.

Such configurations may vary, for example and as illustrated in FIG. 17, the width, height, and exterior configuration of an existing gutter may vary. However, and due to the pliable nature of the present invention, such variations will not affect the application of gutter enhancer 10.

Lower trough covering 20 is of a sufficient size and dimension to provide covering over a variety of existing gutters which have various dimensions. Accordingly, and as a user is preparing to install gutter enhancer 10 over an existing gutter 34 the excess portion of lower trough covering 20 is easily cut by a utility knife or a pair of snips. Moreover, crease 26, which is closest to lower trough covering 20, provides a convenient reference point to match measurements taken from bottom 32 of an existing gutter 34. In addition, lower trough covering 20 can be cut to accommodate the down spouts of an existing gutter system.

As an alternative, gutter enhancer 10 will be manufactured to come in a variety of sizes. Such sizes will provide larger or smaller areas for decorative fascia surface 16, lower trough covering 20, and screen portion 12. Such larger and smaller areas are contemplated to correspond to larger and smaller existing gutter systems.

Accordingly, the present invention can be manufactured in a variety of sizes and the packaging for such sizes will include the sizes and types of existing gutter systems which will easily be covered by gutter enhancer 10.

Referring back now to FIG. 1, screen portion 12 has a plurality of tabs 40 secured along the outer edge of screen portion 12. Tab 40 provide convenient locations for an individual to pull and remove screen portion 12 from its debris blocking position.

As an alternative, as illustrated by the dashed lines in FIG. 5, and to provide a more aesthetical appearance, the excess portion of screen portion 12, not required for blocking the gutter trough, is slid underneath the first or second course of roofing shingles.

As illustrated in FIGS. 1–6, screen portion 12 is also sized to accommodate the standard opening or top 30 of existing gutter 34. Tabs 40 and crease 26 which is closest to screen portion 12 allows an individual to remove screen portion 12 away from top 30 of an existing gutter in order to facilitate the cleaning or any other maintenance required within the confines of the trough.

Since screen portion 12 is integral with gutter enhancer 10, the cleaning of the gutter trough is much safer. For example, an individual will not have to worry about dropping the screen once it is removed from blocking position.

Top molding 14 is configured to provide an aesthetically pleasing ornamental feature generally not provided by a standard gutter trough. Most existing gutters have standard trough design which has no ornamental features at all. Moreover, and as contemplated with the present invention, molding 14 is manufactured in a variety of configurations for offering to the consumer.

Decorative fascia surface 16 also provides an aesthetically pleasing ornamental feature. Decorative fascia surface 16 as well as molding 14 is also available in numerous configurations such as, but not limited to those previously illustrated in FIGS. 13A–16B.

Referring now to FIG. 4, as gutter enhancer 10 and more particularly lower trough covering 20 is manipulated about crease 26, a lower lip 42 is formed between decorative fascia 16 and lower trough covering 20. Lower lip 42 also provides an ornamental feature to glitter enhancer 10.

In addition to providing an ornamental feature, lower lip 42 also provides longitudinal or horizontal support to gutter enhancer 10 and accordingly the trough of an existing gutter system. In addition, creases 26 allow gutter enhancer 10 to be manipulated, and placed over existing gutters of various sizes.

Another advantage of the present invention is that gutter enhancer 10 when placed over an existing gutter system will provide an insulating characteristic to the enhanced system. The improved system will dampen the noises associated with rain and water accumulations running through the trough.

Yet another advantage of the present invention is that gutter enhancer 10 will reinforce and support an existing gutter trough which may have begun to bow downwardly due to metal fatigue, joint wear and tear. Moreover, metal fatigue, joint wear and tear and bowing of an existing gutter system is generally the by-products of a gutter system having little or no debris shielding.

Figure 6:
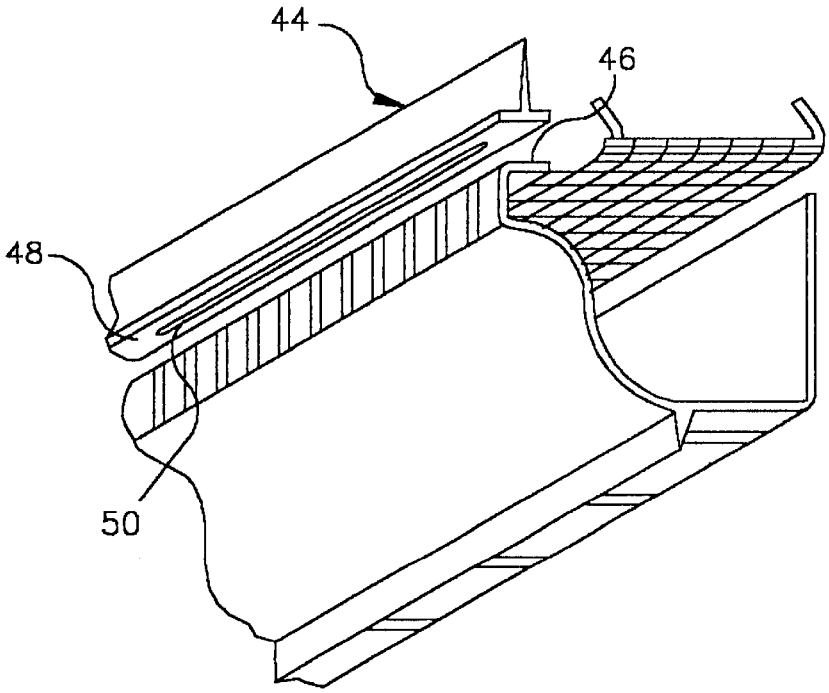
FIG. 6 is a perspective view of an alternative configuration of the present invention.

Referring now to FIG. 6, and as an alternative, a splash guard 44 is installed along an upper edge portion 46. Upper edge portion 46 is formed between top molding 14 and screen portion 12. Splash guard 44 prevents overflow of excessive runoff which may be encountered in severe storms. Splash guard 44 will deflect any excessive runoff back into the trough portion of the gutter The deflection of such runoff will prevent damage to the building structure due to excessive build up of water around the foundation of the building. In addition, the deflection of such runoff will also prevent further damage to the surrounding grounds, such as erosion.

Splash guard 44 has a lower surface portion 48 which is secured to the upper edge portion of gutter enhancer 10 through the use of an adhesive 50.

Figure 7:
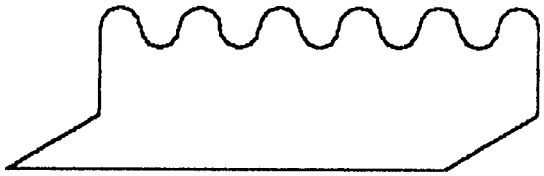
FIG. 7 is a side plane view of an alternative embodiment of the present invention.

Splash guard 44 may also be secured to gutter enhancer 10 through the use of a plurality of screws, rivets, tabs and other securement means. In the preferred embodiment splash guard 44 will be constructed out of the same material and have the same overall appearance as the exterior color and configuration of gutter enhancer 10. However, and to provide a further ornamental aspect to the present invention splash guard 44 can be configured to contrast with gutter enhancer 10 or provide its own ornamental features, such as a decorative design as illustrated in FIG. 7.

Figure 9:
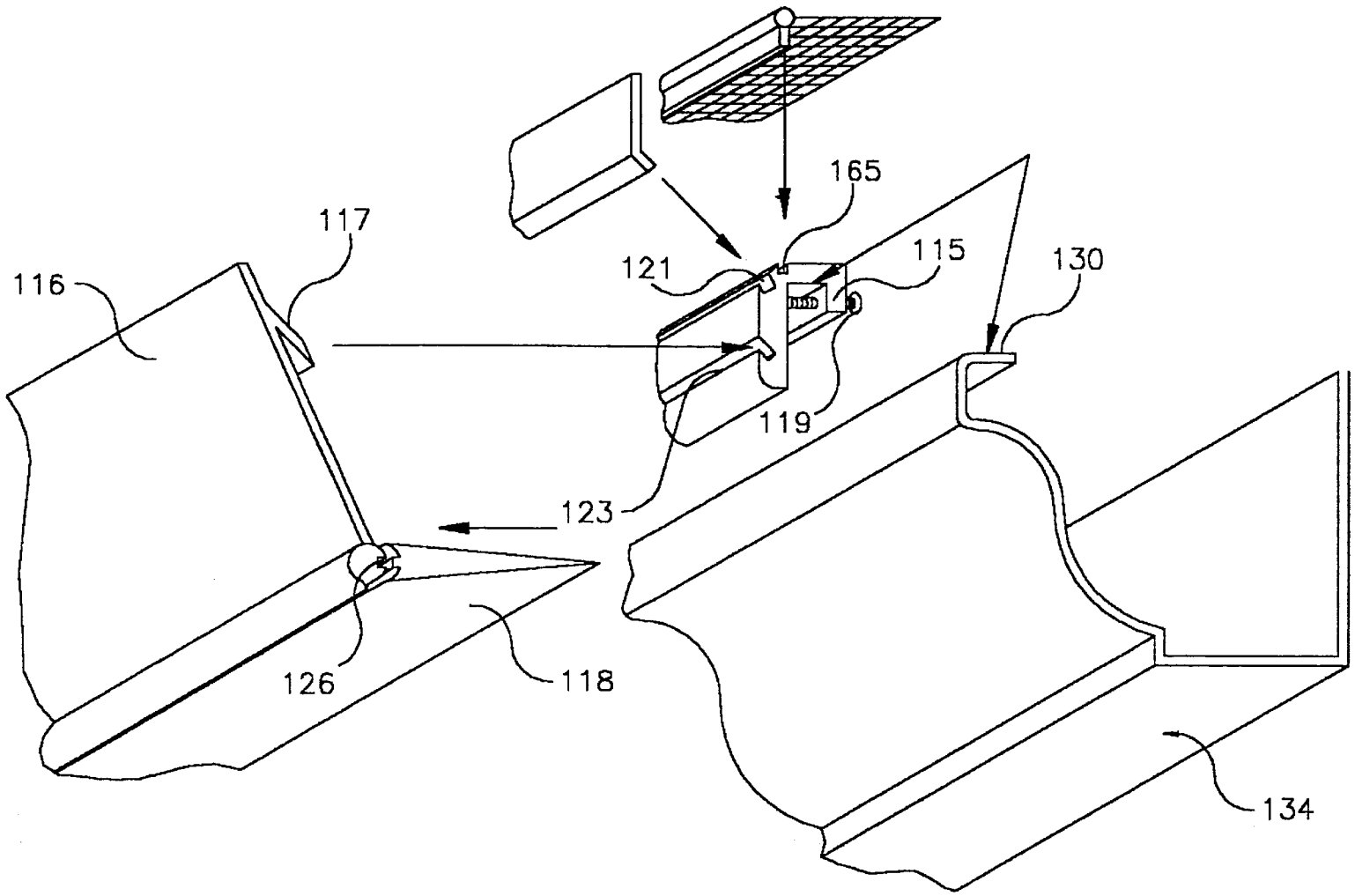
FIG. 9 is a perspective illustrating an alternative embodiment of the present invention.

Turning now to FIG. 9, and alternative embodiment of the present invention is illustrated. Here component parts performing similar or analogous functions are numbered in multiples of 100. In this embodiment gutter enhancer 110 comprises a modular system which is secured to an existing gutter 134. In this embodiment gutter enhancer 110 is either snap fitted to together, or in more permanent applications glued together or a combination of the both.

The modular aspect of this embodiment allows user to choose particular options, such as, the screen portion, and the splash guard option. Moreover, the decorative fascia surface can be changed to an alternative design.

Additionally, the modular aspect of this embodiment also allows the users the option to remove the gutter enhancer during winter months.

In yet another application, gutter enhancer 110 can be easily removed and replaced by an individual. Such applications may be, for example, seasonal enhancements to the existing gutter system.

For example, a Christmas theme may be applied during the winter months and other seasonal themes may be utilized to correspond to the spring, summer and fall months, as well as, holidays. For instance, a patriotic display may be utilized for the Fourth of July.

Here decorative fascia surface 116 has an engagement tab 117 which depends outwardly from backing surface 124 of decorative fascia surface 116.

A channel 126 is positioned along the bottom portion of backing surface 124. Channel 126 is configured to receive and engage an elongated tab portion 127 which depends outwardly from bottom molding 118.

Figure 12:
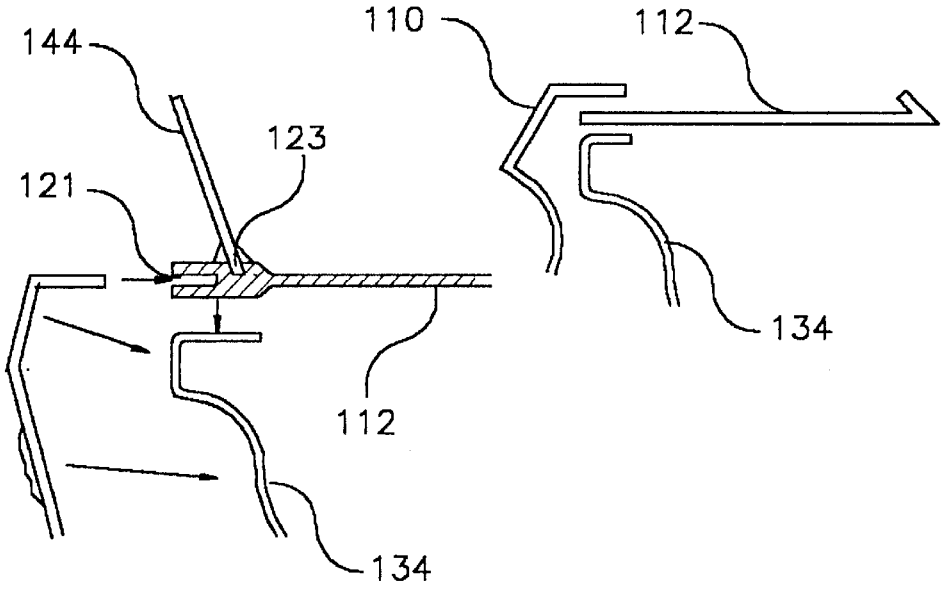
FIG. 12 is a side view of the FIG. 9 embodiment.
Figure 13A:
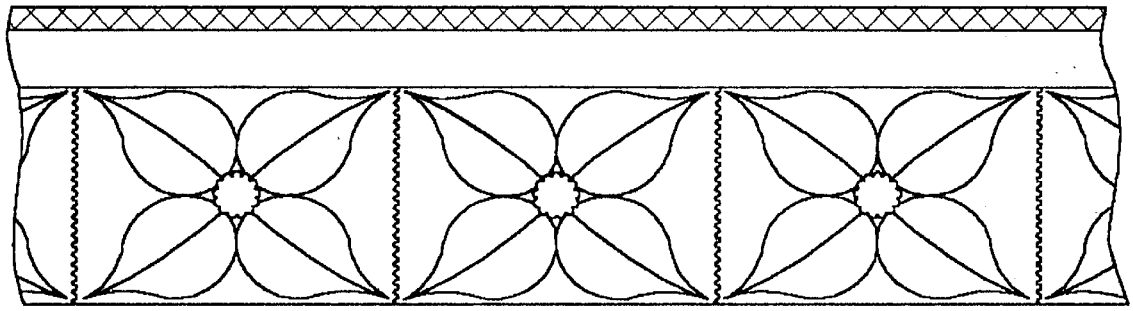
FIG. 13A–B is a view illustrating a possible design features of the present invention.
Figure 13B:
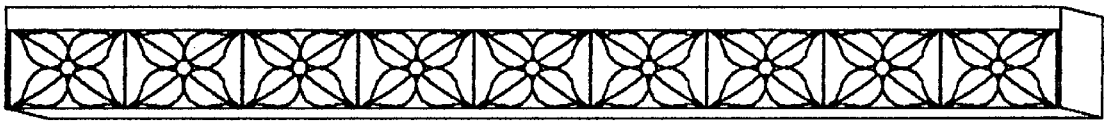
Figure 14A:
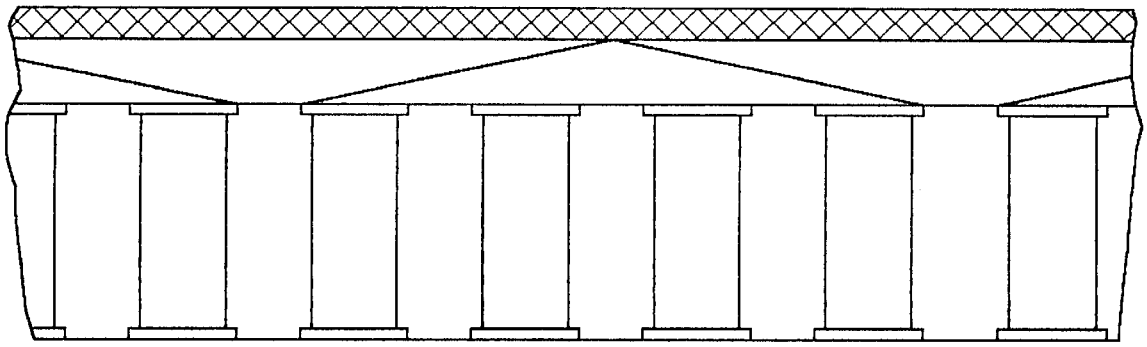
FIG. 14A–B is a view illustrating a possible design features of the present invention.
Figure 14B:
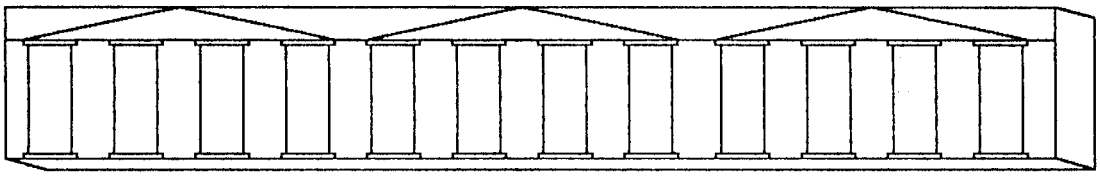
Figure 15A:
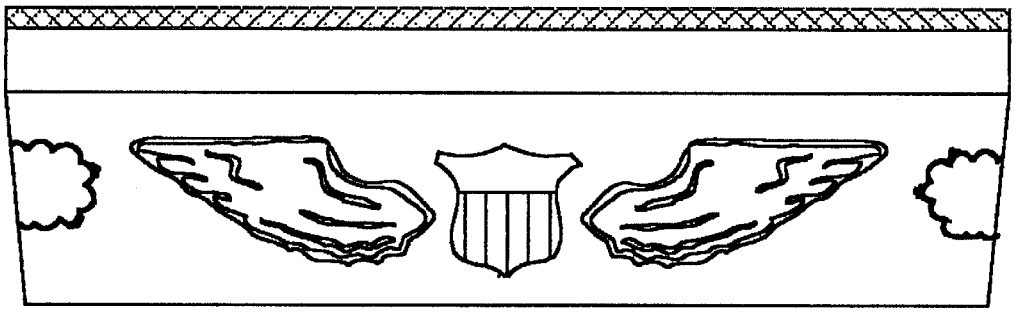
FIG. 15A–B is a view illustrating a possible design features of the present invention.
Figure 15B:
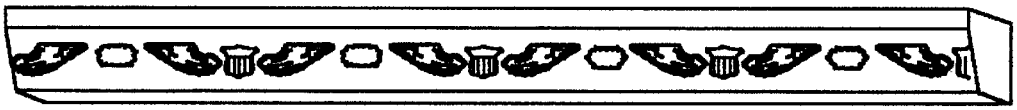
Figure 16A:
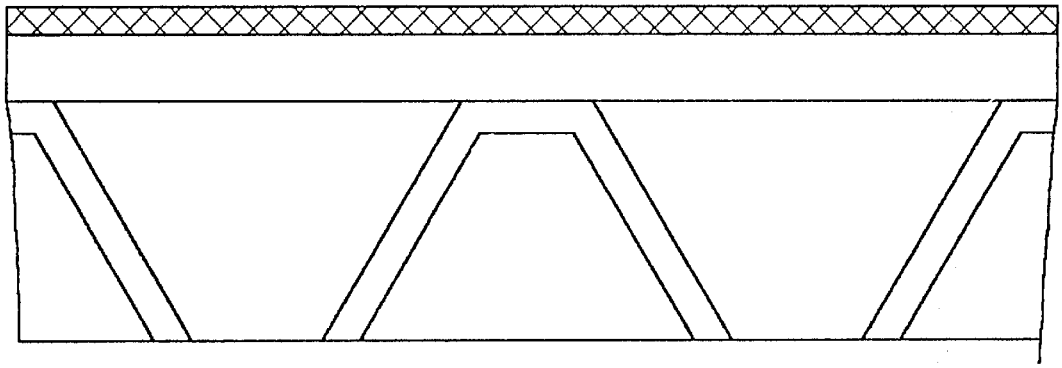
FIG. 16A–B is a view illustrating a possible design features of the present invention.
Figure 16B:
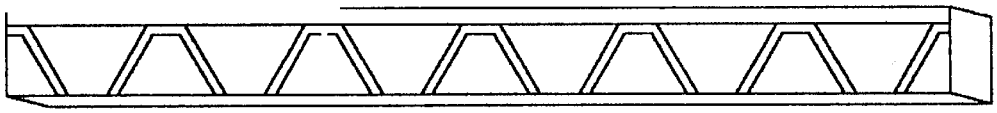

As illustrated in FIG. 9 and 12, bottom molding 118 is received and secured to decorative fascia surface 116 as elongated tab portion 127 is received into channel 126. In order to secure or assist in the securement of bottom molding 118 to decorative fascia surface 116 an adhesive is applied into channel 126 prior to the insertion of tab portion 127.

The upper portion of the decorative fascia surface 116 is secured to an existing gutter 134 through the use of a top molding portion 115. Top molding portion 115 is secured to top 130 of existing gutter 134 through the use of a set screw 119. Set screw 119 allows top molding portion 115 to be placed over the top 130 of existing gutter 134. As set screw 119 is advanced top molding portion 115 is secured to top 130. See also FIG. 10.

Figure 10:
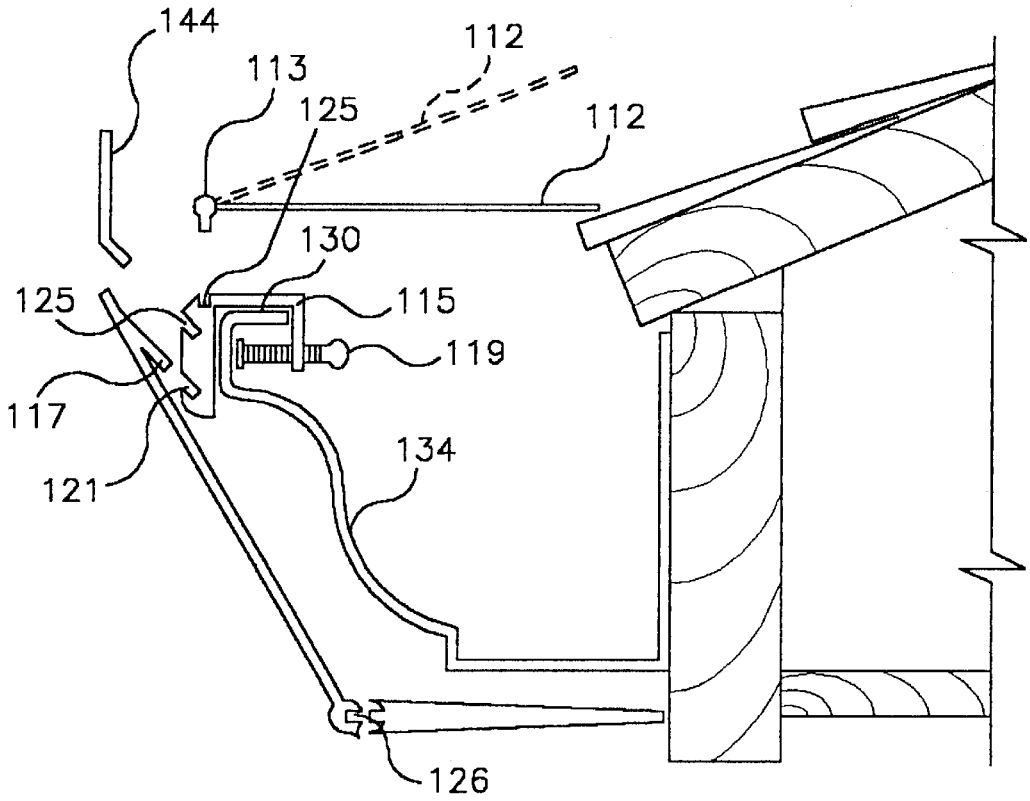
FIG. 10 is a side view of the FIG. 9 embodiment.

Referring now to FIGS. 9 and 10, top molding portion 115 has an elongated opening 121. Elongated opening 121 is configured and positioned to receive engagement tab 117. It is noted that elongated channel 121 and engagement tab 117 are angularly configured so that when engagement tab 117 is inserted into channel 121, decorative fascia surface 116 is positioned to cover existing gutter 134.

As an alternative, engagement tab 117 and elongated opening 121 have matching configurations which may or may not have an angular configuration.

A second elongated opening 123 is positioned on top molding portion 115. Second elongated opening 123 is positioned above elongated opening 121 and is configured to receive a splash guard 144. As illustrated in FIG. 10, the lower portion of splash guard 144 and second elongated opening 123 into which the lower portion of splash guard 144 is to be received are both angularly configured to give splash guard 144 a substantially perpendicular positioning with regard to top molding 115 and top 130 of existing gutter 134.

As an alternative, splash guard 144 and second elongated opening 123 have matching configurations which may or may not have an angular configuration.

A third elongated opening 125 is positioned along the upper surface of top molding portion 115. A screen portion 112 for prevention of debris accumulation in the trough of gutter 134 is secured to a hinge 113. An elongated tab portion 111 is also secured to hinge 113. Here elongated tab portion 111 is received into elongated opening 125 whereby the securement of tab portion 113 into opening 125 allows screen portion 112 to be pivotally secured to top molding portion 115 See also the dashed lines in FIG. 10.

The pivotal mounting of screen portion 112 to top molding portion 115 allows an individual to conveniently lift up screen portion 112 to clear any accumulation of dirt and/or other debris that may adversely affect the performance of gutter 134.

Moreover, and during the cleaning process, an individual simply lifts up or pivots screen portion 112 thereby causing any debris which has accumulated on the upper surface of screen portion 112 to fall downwardly and away from the gutter. Then the debris can be cleaned up from the ground.

This feature of the present invention also makes gutter cleaning safer due to the fact that the individual cleaning the gutter does not have to worry about removing the screen and placing it out of the way while the gutter is being cleaned.

Alternatively, screen portion 112 is flexibly connected to elongated tab portion 111. In this embodiment screen portion 112 is instructed out of a pliable material such as plastic and/or vinyl.

In yet another alternative, and referring in particular to FIG. 12, screen portion 112 is configured to have openings 121 and 123.

Figure 11:
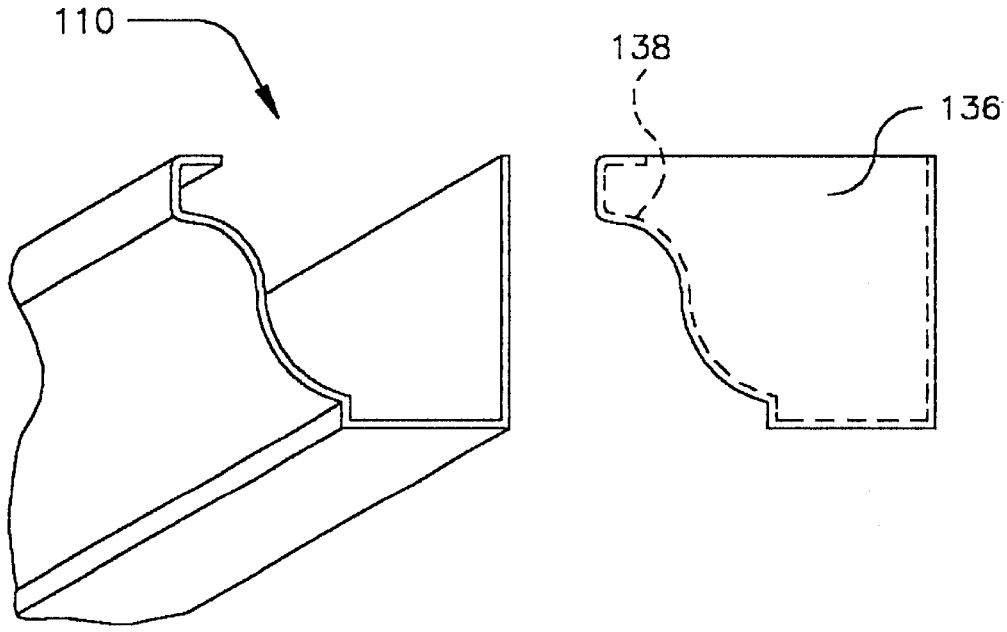
FIG. 11 is a perspective view of the FIG. 9 embodiment.

Referring now to FIG. 11, an end cap 136 is secured to the open end portions of gutter enhancer 110. End cap 136 will also have the decorative features of gutter enhancer 110. End cap 136 has a channel 138, as illustrated by the dashed lines and FIG. 11 which is configured to receive the end portions of gutter enhancer 110.

Figure 18:
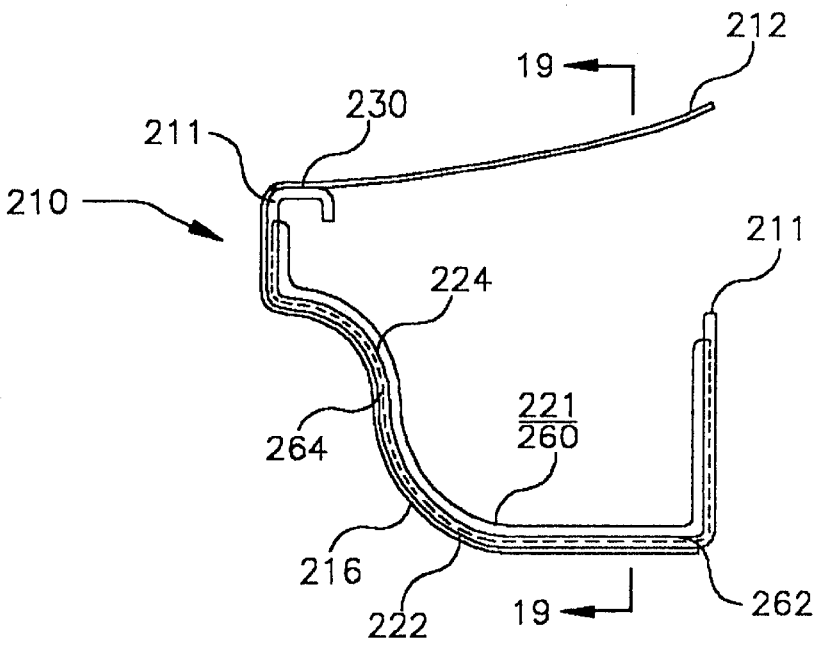
FIG. 18 is a side view of an alternative embodiment of the present invention.

Turning now to FIG. 18, another alternative embodiment of the present invention is illustrated. Here component parts performing similar or analogous functions are numbered in multiples of 100. In this embodiment gutter enhancer 210 comprises a singular system which is secured to an existing gutter 234. In this embodiment gutter enhancer 210 is either snap fitted to the existing gutter, or in more permanent applications glued to the existing gutter or a combination of the both.

The unitary aspect of this embodiment allows user to quickly and easily secure gutter enhancer 210 to the existing gutter 234. Moreover, gutter enhancer 210, and more particularly, the decorative fascia surface 216 of gutter enhancer 210 can easily be changed to an alternative design.

As illustrated in FIG. 18, gutter enhancer 210 comprises a single unit 211 which is manufactured and configured to be snap fitted to, or placed over, an existing gutter. Unit 211 is constructed out of a durable plastic material which has inherent flexible characteristics. Alternatively, unit 211 may be constructed out of other materials having flexible characteristics, including but not limited to the following: vinyl, plastic, Aluminum and Copper.

A flexible screen portion 212 is secured to the top 230 of gutter enhancer 210. The backing surface 224 of gutter enhancer 210 has a compressible foam portion 260 secured to it through use of adhesive material 262.

As an alternative, compressible foam portion 260 may be a flexible rubber material, rubber, foam rubber, foam, air bladder, an insulation material having resilient characteristics or other material having resilient characteristics.

Figure 19:
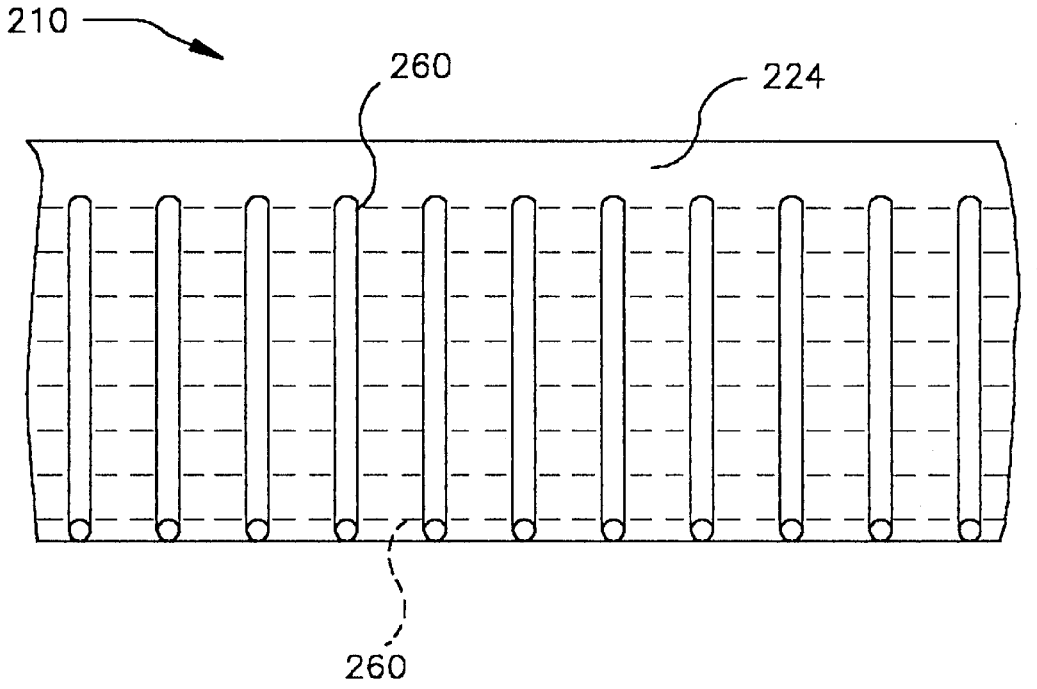
FIG. 19 is a view along lines 19—19 of the FIG. 18 embodiment.

Referring now to FIG. 19, compressible foam portion 260 comprises a plurality of portions which are secured to backing surface 224 of gutter enhancer 210. Alternatively, compressible foam portions 260 are applied in an arrangement as illustrated by the dashed lines in FIG. 19. Other such contemplated arrangements of compressible foam portions 260 include, but are not limited to, the following: zig zags; crossover patterns; parallel lines; orthogonal configurations; and any other variation.

Alternatively, compressible foam portion 260 is applied to the entire backing surface 224.

Referring back now to FIG. 18, and as illustrated by the dashed lines, an alternative application of foam portion 260 is illustrated, a receiving area or plurality of receiving areas 264 is/are positioned on backing surface 224. Receiving area 264 is of a sufficient size to receive a portion of compressible foam 260. In addition, receiving area 264 provides an area in which adhesive 262 can be applied. The incorporation of receiving area 264 into backing surface 224 assists in the production of gutter enhancer 210, namely, the application of compressible foam portions 260.

Gutter enhancer 210 is also configured to have a top lip portion 214. Top lip portion 214 is configured to be placed over and secure gutter enhancer 210 to an existing gutter 234. In addition, gutter enhancer 210 has a rear wall portion 219. Rear wall portion 219 is significantly smaller then a rear wall of an existing gutter 234. This size disparity allows gutter enhancer 210 to be placed over and existing gutter.

Figure 20:
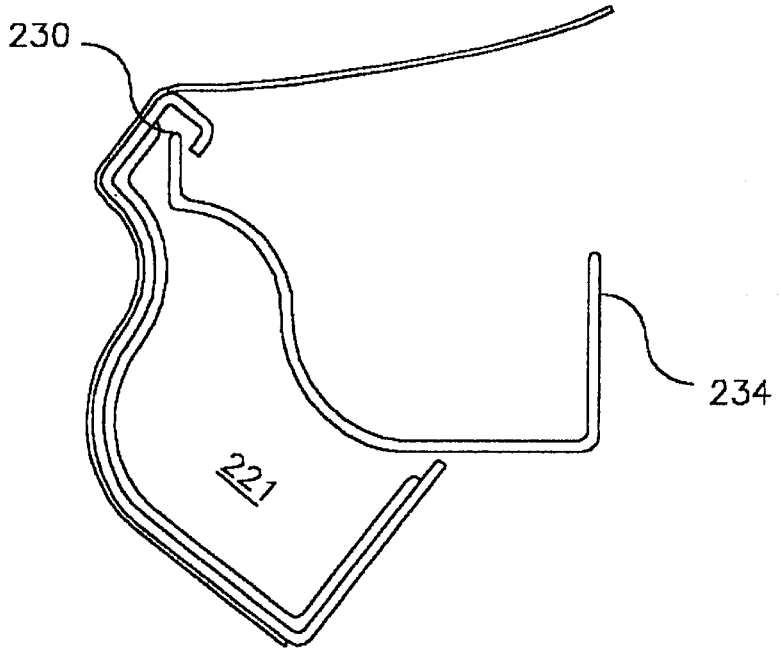
FIGS. 20–22 illustrate an alternative embodiment of the present invention.
Figure 21:
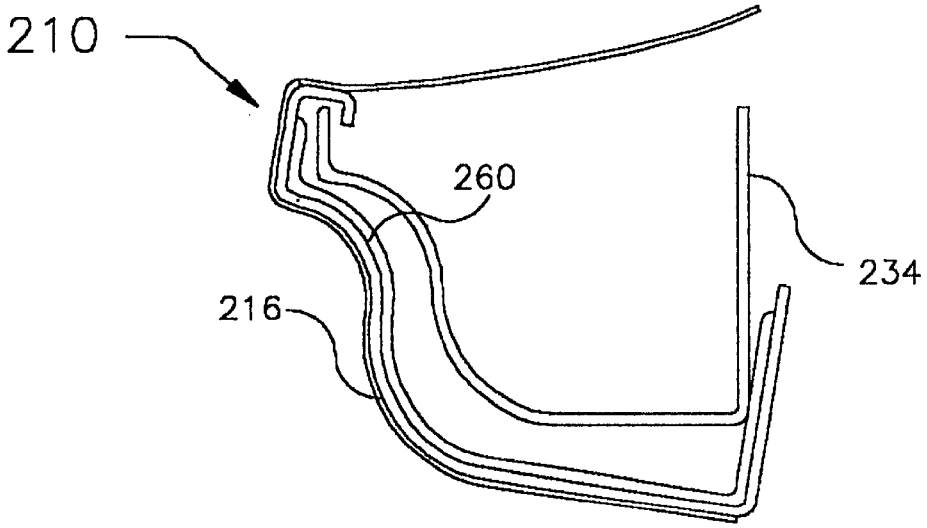
Figure 22:
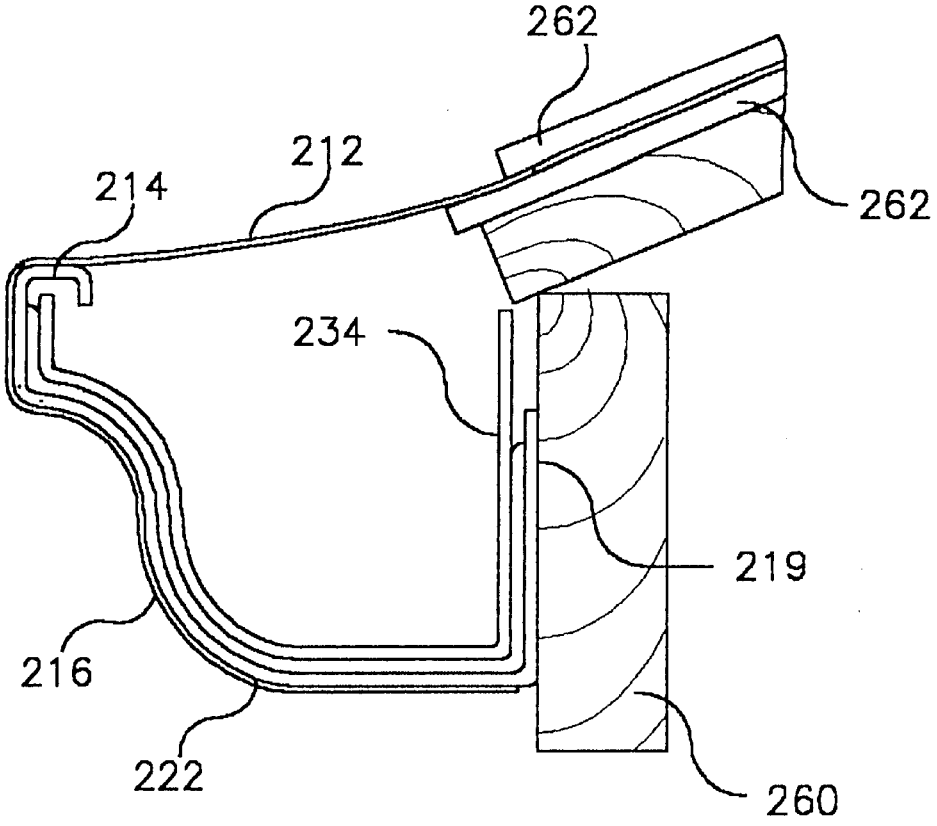
Figure 23:
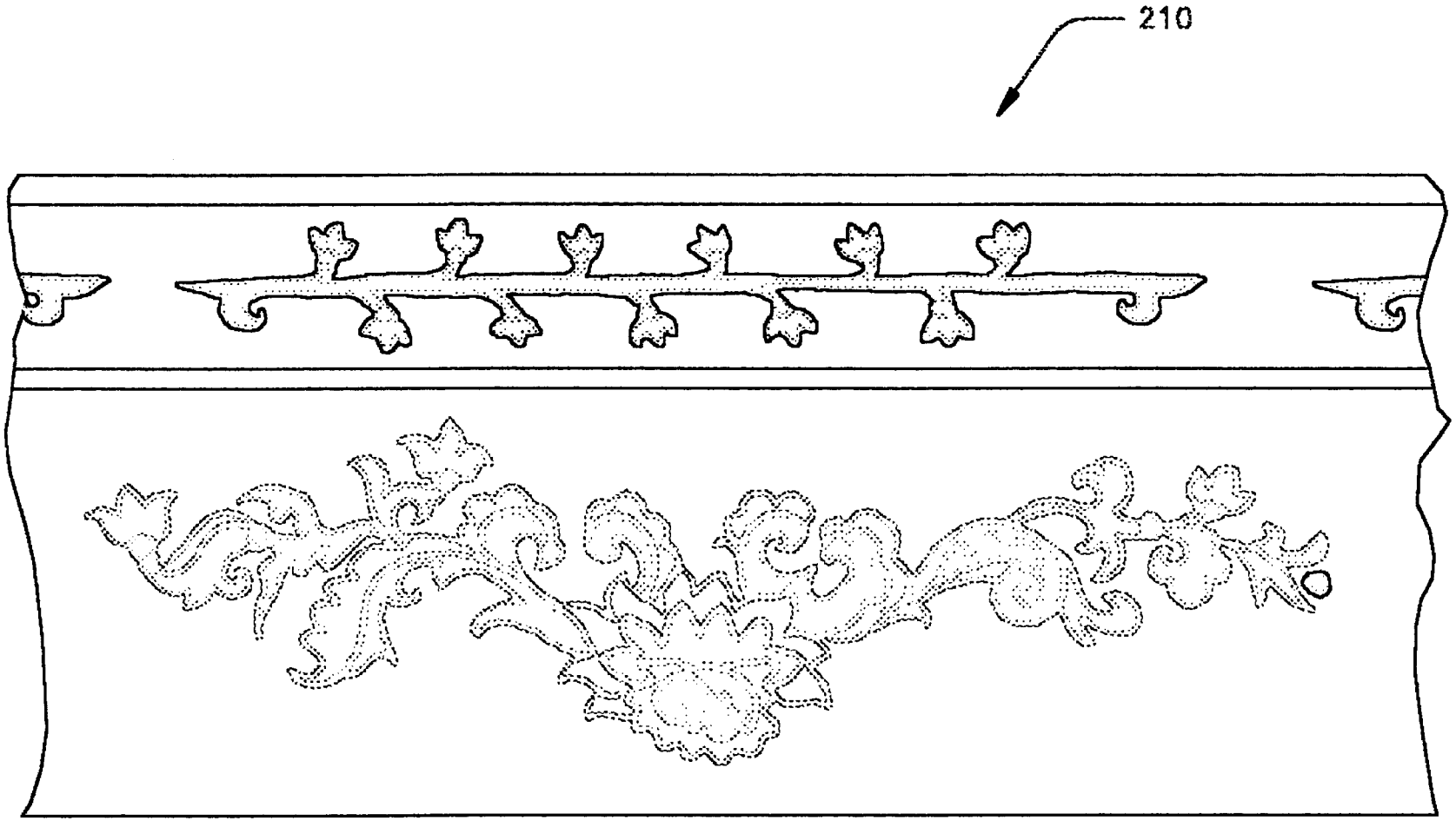
FIG. 23 is a view illustrating possible design features of the present invention.

Turning now to FIGS. 20–22, the installation of gutter enhancer 210 is illustrated. To install gutter enhancer 210 over existing gutter 234, gutter enhancer 210 is angularly positioned so that the top lip portion 214 of gutter enhancer 210 is placed over the top 230 of existing gutter 234 while simultaneously rear wall portion 219 is slid over and around the bottom 232 of existing gutter 234.

As gutter enhancer 210 is slid over an existing gutter 234 compressible foam portion 260 makes contact with existing gutter 234, and accordingly, is depressed to allow gutter enhancer 210 to be placed over existing gutter 234. Once completely installed over an existing gutter compressible foam portion 260 returns to its uncompressed state and the surface area of compressible foam portion 260 makes contact with the existing gutter 234. This feature allows gutter enhancer 210 to be easily installed over an existing gutter without requiring the use any additional securement means such as, adhesive glues, nails, screws and adhesive tape.

Moreover, and in accordance with the present invention gutter enhancer 210 and compressible foam portions 260 are configured to have a receiving area 221. Receiving area 221 has an overall area or volume which is slightly smaller than the outside configuration, area or volume defined by the existing gutter 234. Accordingly, and when gutter enhancer 210 is placed over existing gutter 234 gutter enhancer 210 is snugly onto existing gutter 234.

In addition, and referring in particular to FIG. 22 rear wall portion 219 is positioned in-between existing gutter 234 and fascia board 266. As illustrated in FIGS. 20–22, rear wall portion 219 is significantly shorter than the rear wall portion of existing gutter 234.

In addition, and as a completion to the installation of gutter enhancer 210, flexible screen portion 212 is slid under one of the courses of shingles 262.

A decorative fascia surface 216 is applied to the outer surface 222 of gutter enhancer 210. Decorative fascia surface 216 is a pliable vinyl material which is applied to the outer surface 222 of gutter enhancer 210 through the use of adhesive material 236.

Alternatively, decorative fascia surface 216 is molded directly into the outer surface 222 of gutter enhancer 210.

Some contemplated designs include those, but are not limited to, the designs illustrated in FIGS. 13*a*–16*b* and 23.

As an alternative method for applying gutter enhancer 210, compressible foam portion 260 is applied to the outer surface of existing gutter 234 and gutter enhancer 210 is positioned over the existing gutter 234.

While an illustrative embodiment of the invention has been described, various modifications will be obvious to those skilled in the art. Such modifications are within the spirit and scope of the present invention which is limited and defined only by the appended claims.

What is claimed is:

1. A gutter enhancing device for a gutter of the type having an exterior surface visible when said gutter is installed on a building and defining a gutter trough with an open top, comprising:

a) a flexible member, configured and dimensioned to be applied to and cover at least a portion of the exterior surface of an existing gutter trough, said flexible member having an exposed surface and an unexposed surface;

b) a plurality of creases being positioned in said exposed surface of said flexible member, said creases providing points for bending and forming said flexible member, said creases being positioned, configured and dimensioned to form a gutter of the type having an exterior surface, visible when said gutter is installed on a building, and a gutter trough with an open top; and c) a screen secured to said covering, said screen being configured, dimensioned and positioned to cover the open top of said gutter trough.

2. A gutter enhancing device as in claim 1 further comprising a decorative element secured to said exposed surface.

3. A gutter enhancing device as in claim 1 wherein said flexible member comprises a decorative element.

4. A gutter enhancing device for a gutter of the type having an exterior surface visible when said gutter is installed on a building and defining a gutter trough with an open top, comprising:

a) a flexible member, configured and dimensioned to have a top portion, a facade portion and a bottom portion, said bottom portion being of a sufficient size to cover at least a portion of a bottom portion of an existing gutter trough, said top portion being of a sufficient size and configured to positively engage at least a portion of an exterior lip of said existing gutter trough, said facade portion being of a sufficient size and positioned to cover at least a portion of a side portion of said existing gutter trough, said flexible member also having an exposed surface and an un-exposed surface, said flexible member of being configured to wrap around said existing gutter with said un-exposed surface adjacent to the exterior surface of said existing gutter; and b) a screen portion being secured to said top portion of said flexible member and said screen portion being configured, dimensioned and positioned to cover the open top of said gutter trough.

5. A gutter enhancing device for a gutter of the type having an exterior surface visible when said gutter is installed on a building and defining a gutter trough with an open top, comprising:

a) a covering being sufficiently flexible to be applied to and cover at least a portion of the exterior surface of an existing gutter trough, said covering having an exposed surface and an un-exposed surface;

b) a compressible foam material being applied to said un-exposed surface; and c) a flexible screen portion being secured to said covering, said flexible screen portion being configured, dimensioned and positioned to cover the open top of said gutter trough.

6. A gutter enhancing device comprising:

a) a covering being sufficiently flexible to be applied to and cover at least a portion of an exterior surface of an existing gutter trough, said covering having an exposed surface and an un-exposed surface;

b) an adhesive material being applied to said un-exposed surface; and c) a screen being secured to said covering, said screen being configured, dimensioned and positioned to a the top portion or opening of said gutter trough; and d) a plurality of tabs extending outwardly from said screen.

7. A gutter enhancing device as in claim 6, wherein said covering is elongated in shape and defines two lengthwise edges, said screen is elongated in shape and defines two lengthwise edges, one of said lengthwise edges of said covering being secured to one of said lengthwise edges of said screen, the other lengthwise edges said screen being secured to said tabs.

8. A gutter enhancing device as in claim 6, wherein said screen is configured, dimensioned and positioned to cover the top portion or opening of said gutter trough, said screen having flexible characteristics whereby said flexible characteristics of said screen allow an individual to move said screen from a position screening said existing gutter to facilitate the cleaning of said screen and said existing gutter.

9. A gutter enhancing device comprising:

a) a covering being sufficiently flexible to be applied to and cover at least a portion of the exterior surface of an existing gutter trough, said covering having an exposed surface and an un-exposed surface, additionally said covering further comprises an outer wall and an inner wall, said inner wall being substantially shorter in height that said outer wall, whereby said inner wall facilitates the application of said gutter enhancing device;

b) a compressible foam material being applied to said un-exposed surface; and c) a flexible screen portion being secured to said covering, said flexible screen portion being configured, dimensioned and positioned to cover a top portion or opening of said gutter trough.

10. A method of forming and installing a gutter enhancing device comprising:

a) making a sheet of covering with a plurality of creases;

b) making a roll of said covering;

c) transporting said covering in the form of a roll to a site for formation into a gutter enhancing device;

d) unrolling said sheet of covering;

e) cutting said sheet of covering to appropriate length;

f) bending said sheet of covering at said creases to form a clip, a hook and a gutter portion of said a gutter enhancing device;

g) securing said hook to the front of a gutter;

h) securing said clip to the rear of said gutter.

11. A method as in claim 10 wherein said bending is done by a machine.

12. A method as in claim 10 wherein said site of formation is the site of installation.

13. A gutter enhancing device for a gutter of the type having an exterior surface visible when said gutter is installed on a building and defining a gutter trough with an open top, comprising:

a) a covering member configured to be applied to and cover at least a portion of the exterior surface of an existing gutter trough, said covering member having an exposed surface and an un-exposed surface;

b) an adhesive material secured to said un-exposed surface; and c) a screen secured to said covering, said screen being configured, dimensioned and positioned to cover the open top of said gutter trough; wherein said covering member comprises a decorative element, said decorative element being sculptured.

* * * * *